US011084510B2

(12) United States Patent
Chen et al.

(10) Patent No.: US 11,084,510 B2
(45) Date of Patent: Aug. 10, 2021

(54) BOLSTER OF BOGIE

(71) Applicant: CRRC TANGSHAN CO., LTD., Tangshan (CN)

(72) Inventors: Yanhong Chen, Tangshan (CN); Jixiang Guo, Tangshan (CN); Lei Dong, Tangshan (CN); Chunlai Li, Tangshan (CN); Rong Ma, Tangshan (CN)

(73) Assignee: CRRC TANGSHAN CO., LTD., Tangshan (CN)

( * ) Notice: Subject to any disclaimer, the term of this patent is extended or adjusted under 35 U.S.C. 154(b) by 243 days.

(21) Appl. No.: 16/231,011

(22) Filed: Dec. 21, 2018

(65) Prior Publication Data

US 2019/0118839 A1 Apr. 25, 2019

Related U.S. Application Data

(63) Continuation of application No. PCT/CN2016/102657, filed on Oct. 20, 2016.

(51) Int. Cl.
*B61F 5/52* (2006.01)
*B61F 5/04* (2006.01)
(Continued)

(52) U.S. Cl.
CPC ..... *B61F 5/52* (2013.01); *B61F 5/04* (2013.01); *B61F 5/06* (2013.01); *B61F 5/08* (2013.01); *B61F 5/10* (2013.01); *B61F 5/12* (2013.01)

(58) Field of Classification Search
CPC ..... B61F 5/04; B61F 5/06; B61F 5/08; B61F 5/10; B61F 5/12; B61F 5/22; B61F 5/24; B61F 5/52
See application file for complete search history.

(56) References Cited

U.S. PATENT DOCUMENTS 3,547,046 A 12/1970 Lich
3,717,107 A 2/1973 Pangalila ..... 105/199
(Continued)

FOREIGN PATENT DOCUMENTS

BE 724 902 A 5/1969
CN 2517641 Y 10/2002
(Continued)

OTHER PUBLICATIONS

The International Search Report of corresponding International PCT Application No. PCT/CN2016/102657, dated Mar. 30, 2017.
(Continued)

*Primary Examiner* — Robert J McCarry, Jr.
(74) *Attorney, Agent, or Firm* — J.C. Patents

(57) ABSTRACT

Disclosed is a bolster of a bogie, wherein a secondary suspension connected with a transverse beam of the bogie is arranged below the bolster, and a third suspension connected with a vehicle body is arranged above the bolster. The bolster of the bogie of the present invention realize a functional separation by adding a suspension between the bottome of the bolster and the transverse beam to make the frame and the vehicle body be connected through a two-stage suspension, so that the third suspension above the bolster is only used to undertake a transverse displacement function, and the secondary suspension under the bolster is only used to undertake a rotation function, thereby further increasing displacement and relative rotation angle between the vehicle body and the bogie when the vehicle passes through a curve, and improving curve passing capability of the vehicle.

11 Claims, 23 Drawing Sheets

(51) Int. Cl.

| | |
|---|---|
| ***B61F 5/06*** | (2006.01) |
| ***B61F 5/08*** | (2006.01) |
| ***B61F 5/10*** | (2006.01) |
| ***B61F 5/12*** | (2006.01) |

(56) References Cited

U.S. PATENT DOCUMENTS

| | | | | |
|---|---|---|---|---|
| 3,807,313 | A | 4/1974 | Koyanagi | 104/148 |
| 3,818,841 | A | 6/1974 | Francois et al. | 105/164 |

FOREIGN PATENT DOCUMENTS

| | | | | |
|---|---|---|---|---|
| CN | 201021148 | Y | 2/2008 | |
| CN | 201737001 | U | 2/2011 | |
| CN | 202115541 | U | 1/2012 | |
| CN | 103770803 | A | 5/2014 | |
| CN | 105923007 | A | 9/2016 | |
| CN | 106004915 | A | 10/2016 | |
| CN | 205916142 | U | 2/2017 | |
| CN | 205930747 | U | 2/2017 | |
| EP | 0 393 177 | A1 | 10/1990 | |
| EP | 0393177 | A1 * | 10/1990 | B61F 5/24 |
| GB | 997 305 | A | 7/1965 | |
| KR | 10-1326858 | B1 | 11/2013 | |

OTHER PUBLICATIONS

The Chinese First Examination Report of corresponding China patent application No. 201610450925.5, dated Aug. 17, 2017.
The Chinese Second Examination Report of corresponding China patent application No. 201610450925.5, dated Apr. 19, 2018.
The extended European Search Report of corresponding European application No. 16906094.4-1010, dated Jan. 27, 2020.

* cited by examiner

BOLSTER OF BOGIE

CROSS-REFERENCE TO RELATED APPLICATIONS

This application is a continuation of International Application No. PCT/CN2016/102657, filed on Oct. 20, 2016, which claims the priority benefit of China Patent Application No. 201610450925.5, filed on Jun. 21, 2016. The contents of the above identified applications are incorporated herein by reference in their entireties.

FIELD OF THE INVENTION

The invention relates to the technical field of a bogie of a high-speed railway vehicle, in particular to a bolster of a bogie.

BACKGROUND OF THE INVENTION

A bogie is an important part of a railway vehicle and is used for carrying the vehicle, providing traction force, damping and guiding, and a power bogie is further used for providing power for driving the railway vehicle to move forward.

The bogie includes a bogie with a bolster and a bogie without bolster, the bogie in the prior art typically comprises a frame, a wheelset, an axle box and the like, wherein the axle box is connected with the frame through a primary suspension, and the frame is connected with the vehicle body through a secondary suspension. The suspension devices typically comprises a resilient supporting member (e.g., a spring) and a damping member for absorbing energy (e.g., a hydraulic damper). FIG. 27 is a schematic structural view of a bogie in CRH3 series in the prior art, which comprises two side beams, two transverse beams and two longitudinal beams welded together to form an H-shaped box structure, the side beams are a concave U-shaped structure formed by welding a steel plate, the concave portion of each side beams is provided with an air spring, which is used as a third suspension supporting member to be connected with the vehicle body.

The drawback of the prior art is that, when the wheel is in the course of curvilinear motion, rotation and transverse movement between the vehicle body and the bogie are realized only by means of the transverse displacement of the air spring, an allowable offset between the vehicle body and the bogie is small, and it is impossible to pass a small turning radius smoothly. Thus safety operation of a vehicle adopting such a bogie requires large turning radius.

SUMMARY OF THE INVENTION

In view of the above defect existing in the prior art, a technical problem to be solved in this invention is to provide a bolster of a bogie and a bogie adopting the bolster, increasing displacement and rotation angle between the vehicle body and the bogie, improving curve passing capability of the vehicle and adaptability of the vehicle to road conditions.

In order to solve the problem, the present invention provides a bolster of a bogie, wherein a traction pin is arranged in the middle of a lower side of the bolster, and the bolster is connected with a transverse beam of the bogie through the traction pin.

Preferably, the traction pin is sleeved with an elastic pin sleeve.

Preferably, a secondary suspension connected with the transverse beam of the bogie is arranged below the bolster, and a third suspension connected with the vehicle body is arranged above the bolster.

Preferably, the third suspension comprises any one of a plurality of laminated rubber piles, air springs and spiral steel springs, or any combination thereof.

Preferably, the secondary suspension comprises any one of a plurality of laminated rubber piles, air springs and spiral steel springs, or any combination thereof.

Preferably, a transverse buffer is arranged in the middle of one side of the bolster, the transverse buffer is in an open shape, and two opposite stop side surfaces are respectively provided with a buffer rubber.

Preferably, two transverse dampers are oppositely arranged on the other side of the bolster, one end of each transverse damper is connected with the bolster, and the other end is connected with the bottom of the vehicle body.

Preferably, two ends of the bolster are respectively provided with a secondary vertical damper.

Preferably, the bolster further comprises a Z-shaped traction rod, the two ends of the bolster are respectively provided with a first mounting seat, rubber nodes are arranged at two ends of the traction rod, one end of the traction rod is arranged on the first mounting seat, and the other end of the traction rod is connected with the vehicle body.

Preferably, the bolster further comprises an anti-yaw damper, one end of the anti-yaw damper is arranged on the first mounting seat, and the other end is connected with a side beam of the frame of the bogie.

Preferably, the elastic pin sleeve is a laminated metal-rubber structure.

Preferably, a central pin hole is formed in the middle of an upper side of the bolster, and is used for accommodating a rigid stop pin arranged in the center of a bolster of the vehicle body.

The bolsterer of the bogie of the present invention realize a functional separation by adding a suspension between the bottom of the bolster and the transverse beam to make the frame and the vehicle body be connected through a two-stage suspension, so that the third suspension above the bolster is only used to undertake a transverse displacement function, and the secondary suspension under the bolster is only used to undertake a rotation function, thereby further increasing relative rotation angle between the vehicle body and the bogie when the vehicle passes through a curve, and improving curve passing capability of the vehicle.

DETAILED DESCRIPTION

The present invention will be further described in detail below with reference to the accompanying drawings and specific embodiments, which are not as a limitation of the present invention.

Firstly, it should be noted that a frame and a bolster forming the bogie are independent components, can be independently produced and then assembled, but in order to clearly illustrate the structure of the frame or the bolster, in the specification of the present application, the bogie is introduced as a whole structure including the frame and the bolster forming the bogie, in order to understand the structure and working principle of the bogie. However, this does not mean that the frame and the bolster in this embodiment are not separable.

Embodiment I

Figure 1:
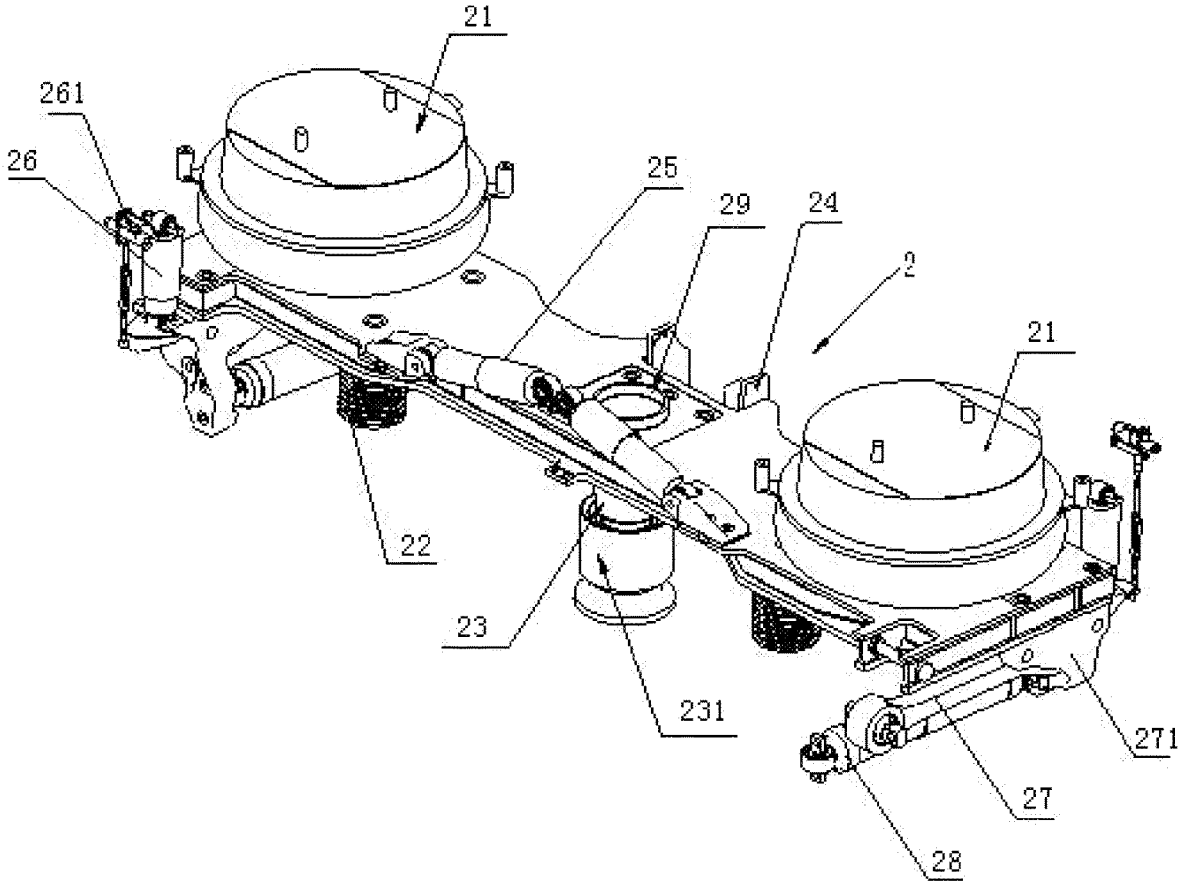
FIG. 1 is a schematic perspective view of a bolster of a bogie according to embodiment I of the present invention.
Figure 2:
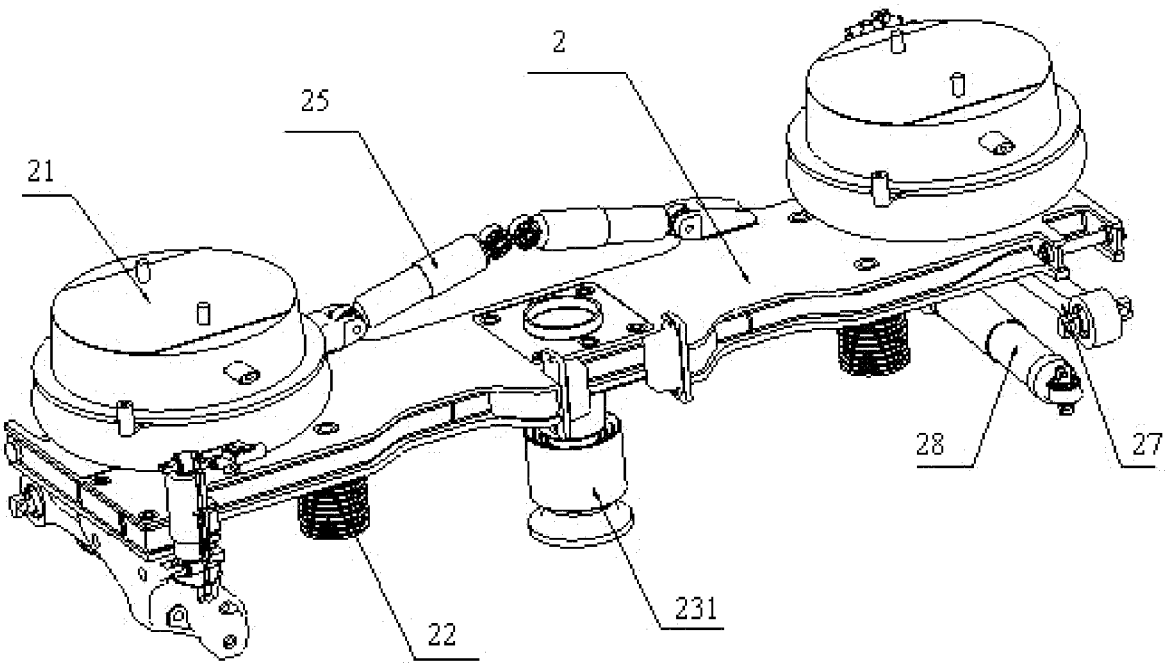
FIG. 2 is a schematic perspective view from another direction in FIG. 1.
Figure 3:
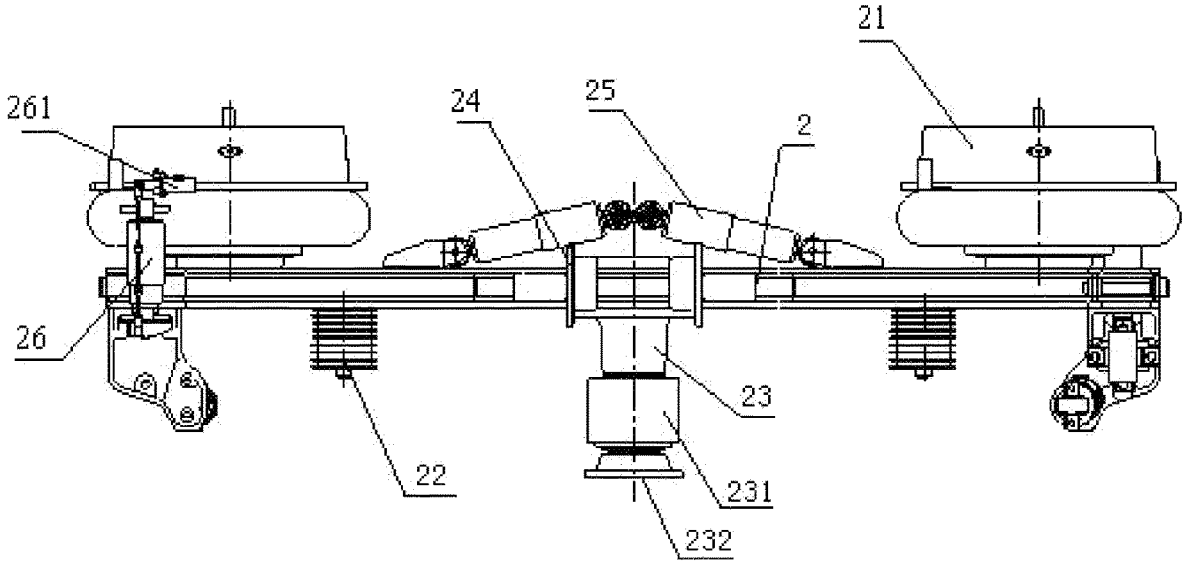
FIG. 3 is a front view of FIG. 1.
Figure 4:
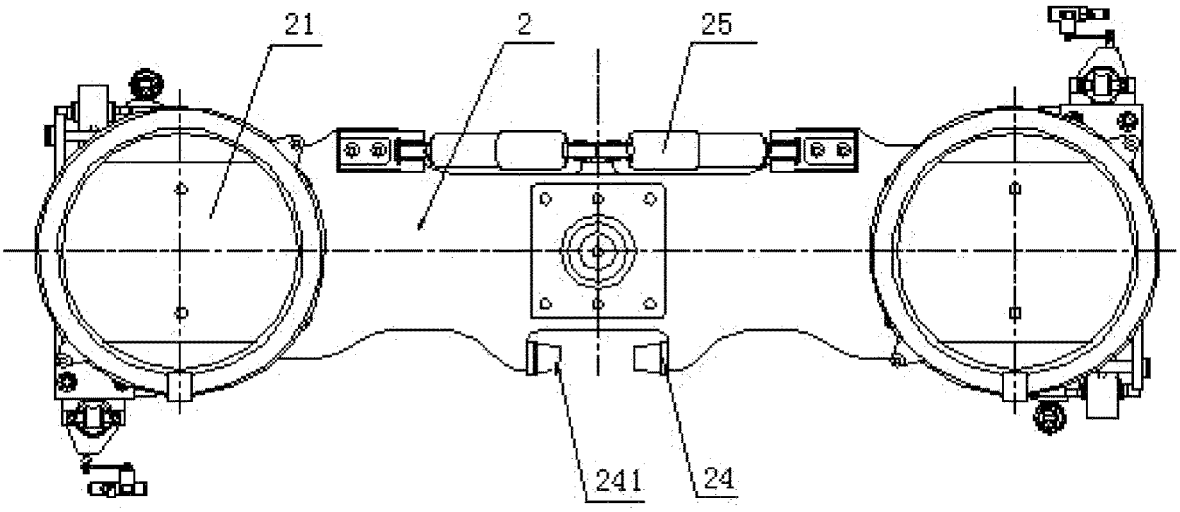
FIG. 4 is a top view of FIG. 3.
Figure 5:
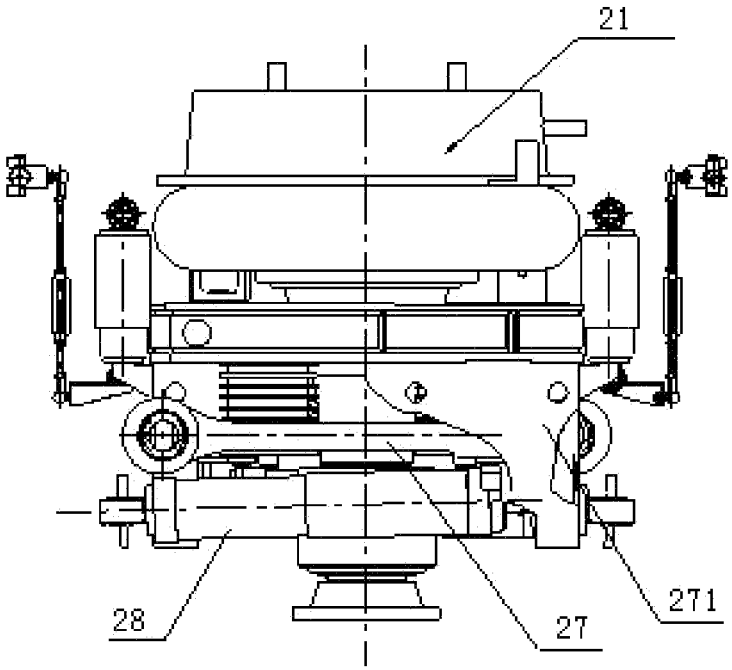
FIG. 5 is a left view of FIG. 3.

FIG. 1 is a schematic perspective view of a bolster of a bogie according to embodiment I of the present invention; FIG. 2 is a schematic perspective view from another direction in FIG. 1; FIG. 3 is a front view of FIG. 1; FIG. 4 is a top view of FIG. 3; FIG. 5 is a left view of FIG. 3.

Figure 6:
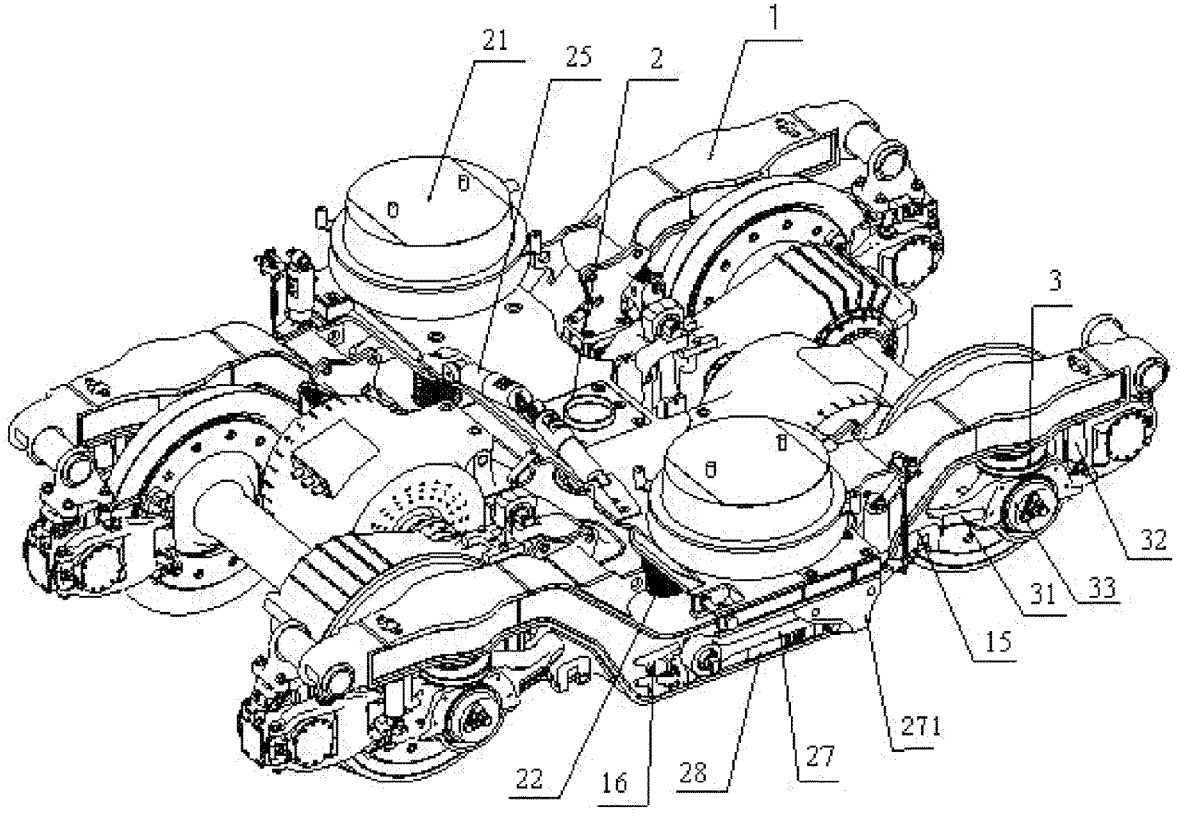
FIG. 6 is a schematic perspective view of a bogie using the bolster of embodiment I.
Figure 7:
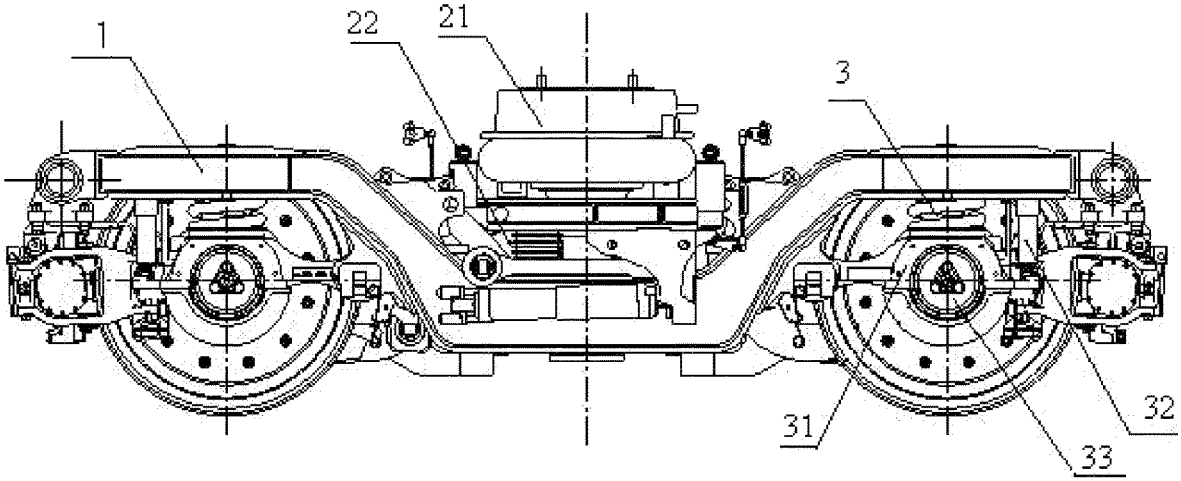
FIG. 7 is a front view of FIG. 6 (viewed from one side of a traveling direction)
Figure 8:
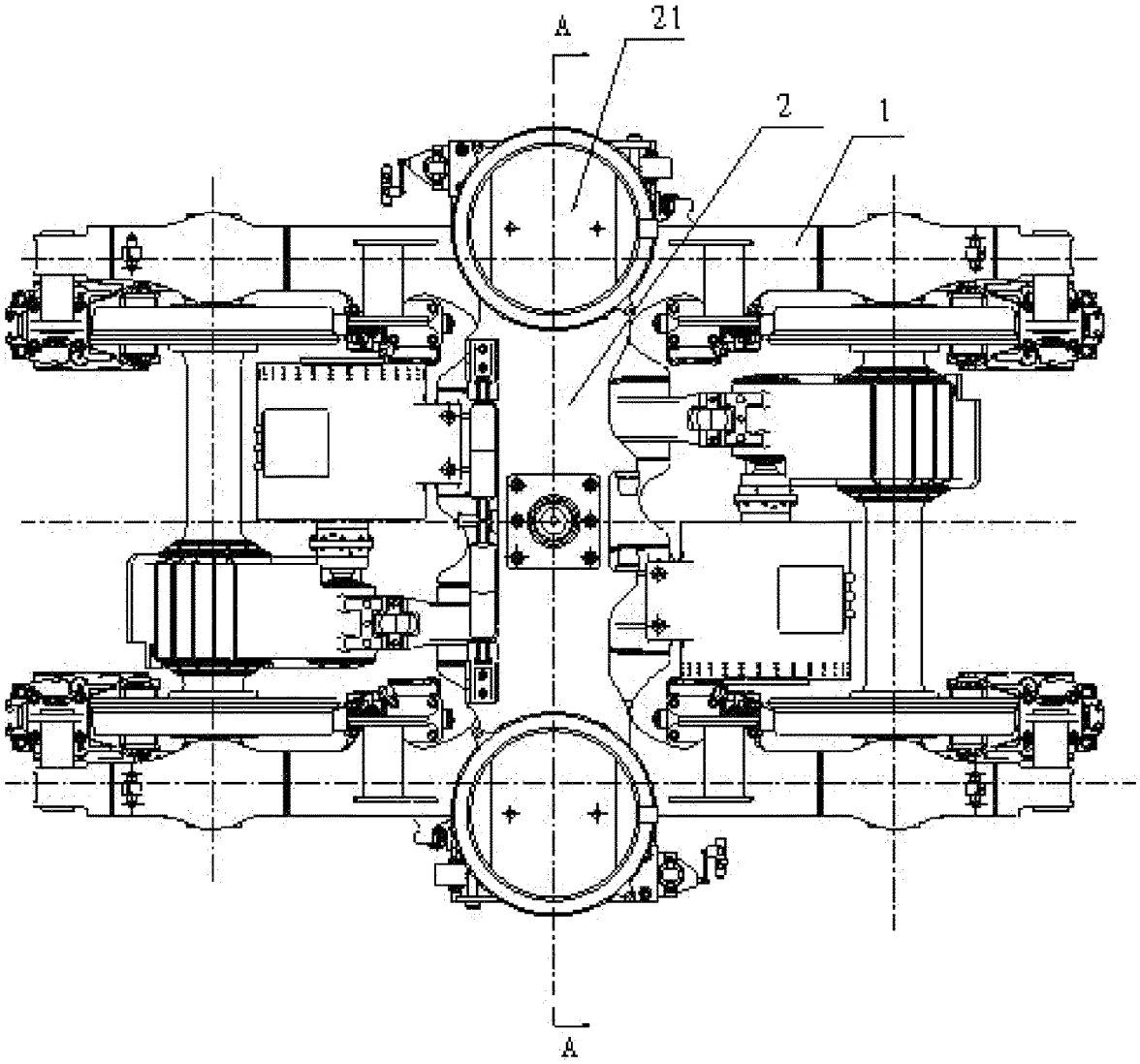
FIG. 8 is a top view of FIG. 6.
Figure 9:
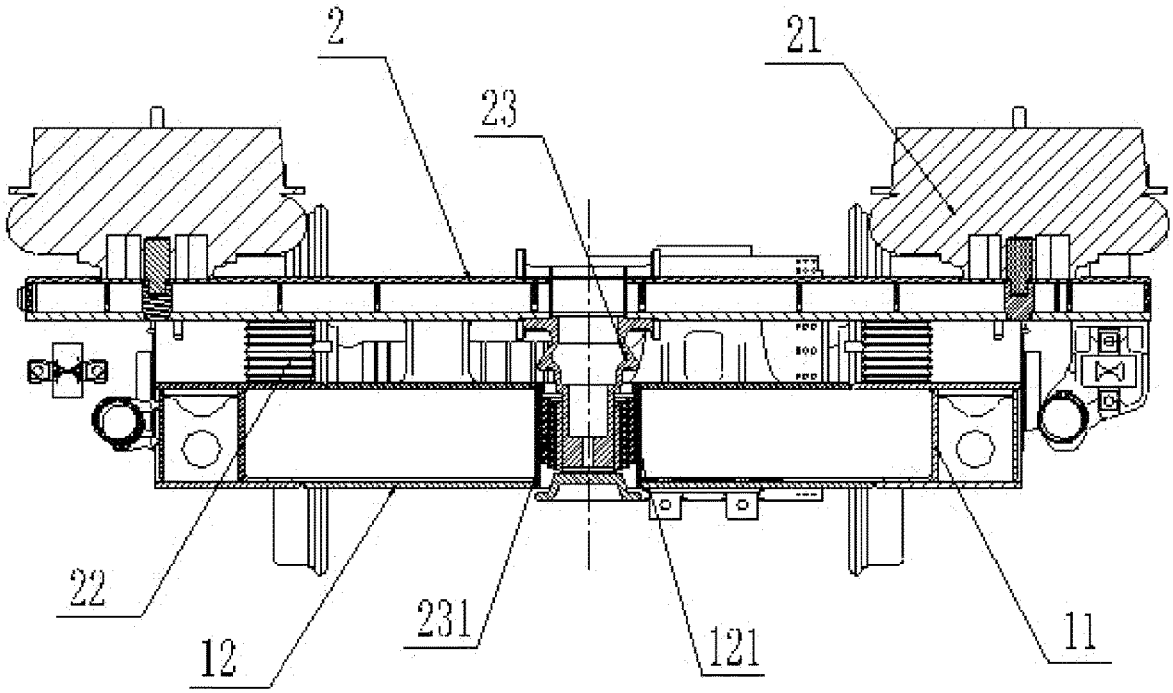
FIG. 9 is a cross-sectional view taken along line A-A of FIG. 8.

FIG. 6 is a schematic perspective view of a bogie using the bolster in embodiment 1; FIG. 7 is a front view of FIG. 6 (viewed from one side of a traveling direction); FIG. 8 is a top view of FIG. 6; FIG. 9 is a cross-sectional view taken along line A-A of FIG. 8.

Figure 10:
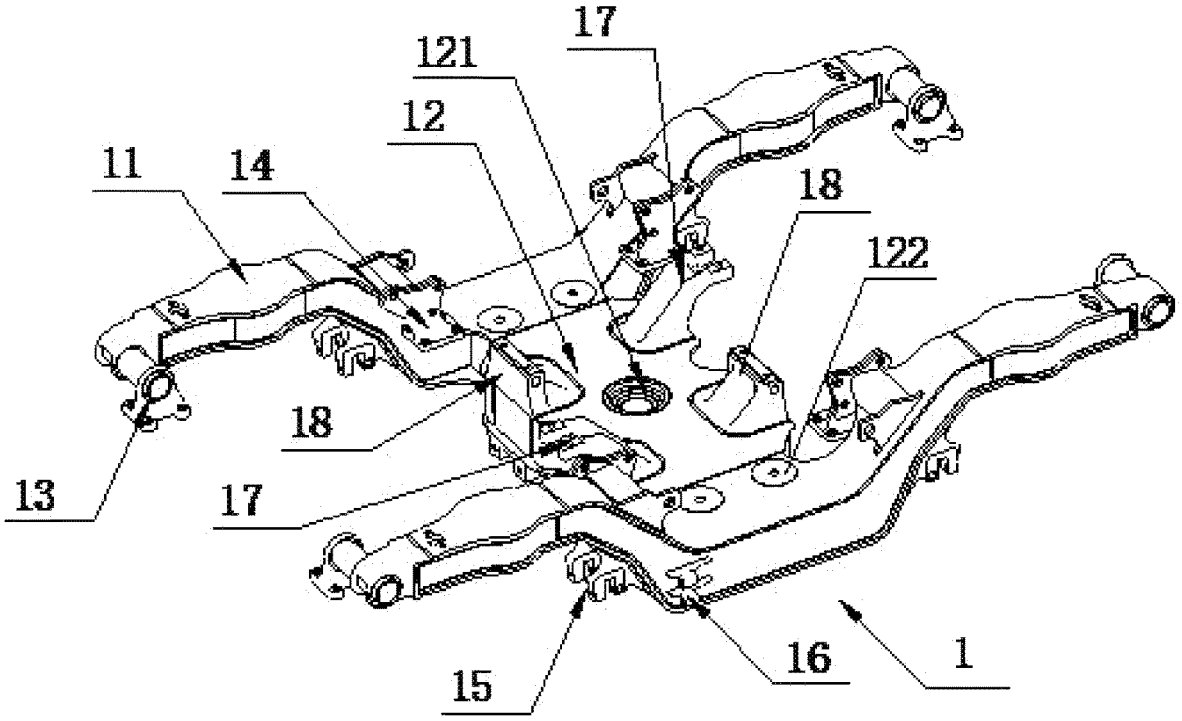
FIG. 10 is a schematic perspective view of a frame of a bogie using the bolster in embodiment I.
Figure 11:
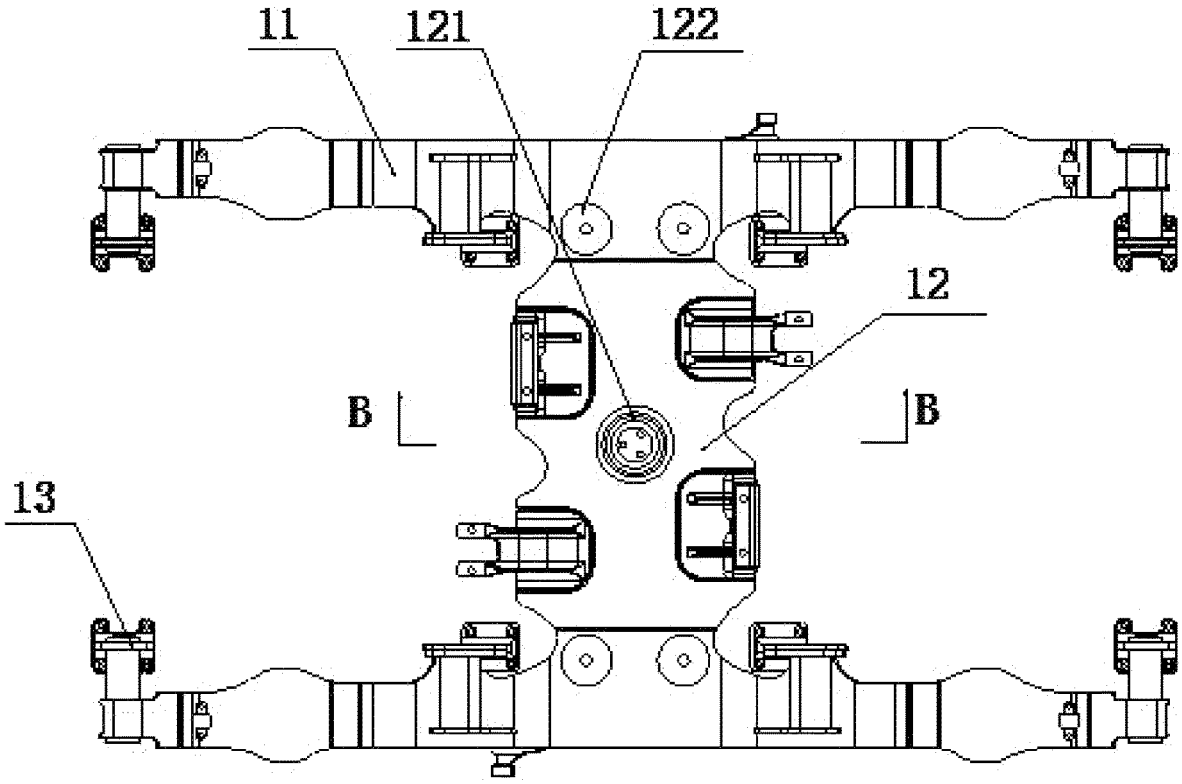
FIG. 11 is a top view of the frame shown in FIG. 10.
Figure 12:
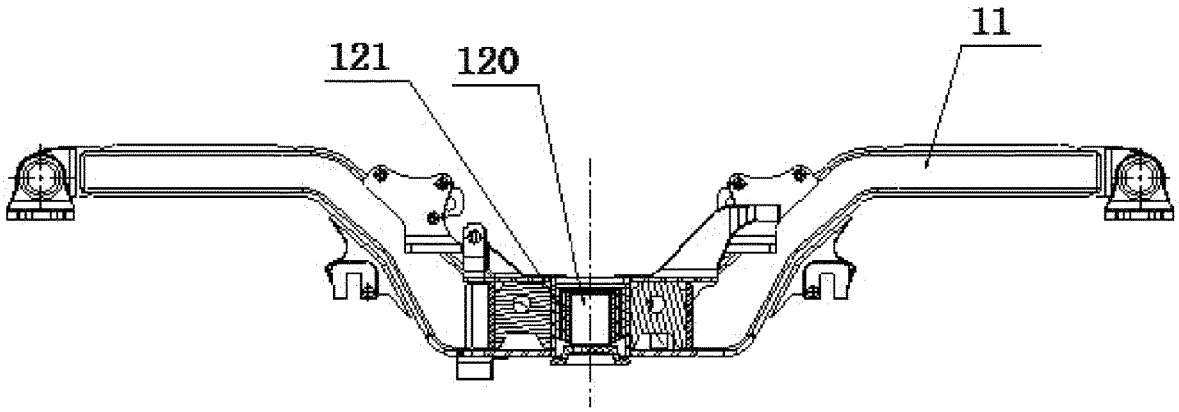
FIG. 12 is a cross-sectional view taken along line B-B of FIG. 11.
Figure 13:
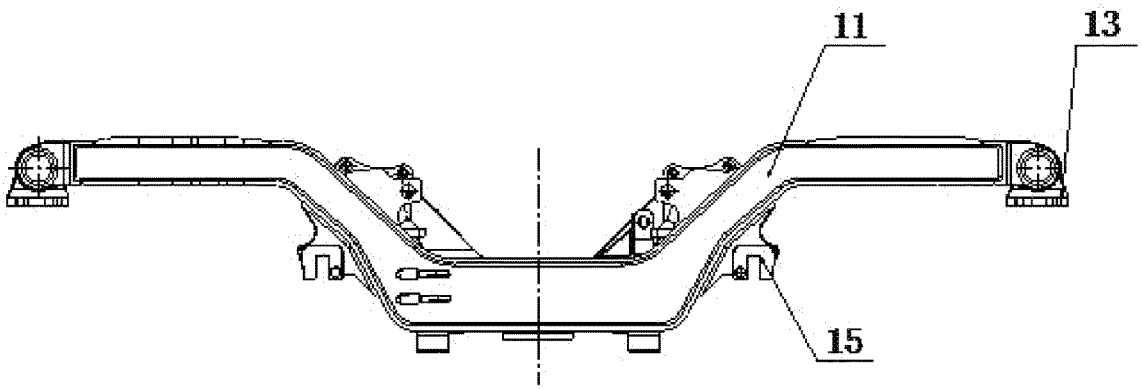
FIG. 13 is a front view of the frame shown in FIG. 10 (viewed from one side of a traveling direction)

FIG. 10 is a schematic perspective view of a frame of a bogie using the bolster in embodiment 1; FIG. 11 is a top view of the frame shown in FIG. 10; FIG. 12 is a cross-sectional view taken along line B-B of FIG. 11; FIG. 13 is a front view of the frame shown in FIG. 10 (viewed from one side of a traveling direction).

As shown in FIGS. 1-5, a bolster 2 of a bogie according to embodiment I of the present invention is as shown in FIG. 1. A traction pin 23 is arranged in the middle of a lower side of the bolster 2, and the bolster 2 is connected with a transverse beam of a frame (see below) through the traction pin 23. The bolster 2 connected with the transverse beam of the frame through the traction pin can achieve a rotary motion between the bolster 2 and the transverse beam of the frame. Preferably, the traction pin 23 is provided with an elastic pin sleeve 231, so as to achieve a connection structure without lubrication. Continuing to refer to FIGS. 1 to 5, a third suspension connected with the vehicle body is arranged above the bolster 2, and a secondary suspension connected with the transverse beam of the bogie is arranged below the bolster 2. In the embodiment shown in FIGS. 1-5, the third suspension uses a first air spring 21 as a supporting member, specifically, above the bolster 2, a first air spring 21 is arranged at the left end and the right end of the bolster 2 respectively; the secondary suspension uses a plurality of first laminated rubber piles 22 as supporting member, namely under the bolster 2, two first laminated rubber piles 22 are arranged at each of two ends of the bolster 2. The bolster 2 is used as a foundation for installing and bearing other components, and the secondary suspension and the third suspension are connected to the bolster 2.

As shown in FIGS. 6-9, and with reference to FIGS. 1-5, a bogie using the bolster 2 of the present invention comprises a frame 1 and a bolster 2. As shown in FIGS. 10-13, the frame 1 is H-shaped, comprises two side beams 11 parallel to each other and the transverse beam 12 connected to the middles of the side beams 11, the middles of the side beams 11 are recessed into a U-shape to form concave portions for mounting the bolster 2, and a primary suspension is arranged between each of both ends of each side beam 11 and the rotating arm axle box 31, and a secondary suspension is arranged between a lower side of the bolster 2 and the transverse beams 12, and a third suspension connected with the vehicle body (not shown in the figures) is arranged on an upper side of the bolster 2. In the present embodiment, the primary suspension includes an axle box spring 3 and a primary vertical damper 32, both of which are arranged between the rotating arm axle box 31 and the frame 1, wherein the axle box spring 3 is a double coil steel spring, and is placed at the top of the rotating arm axle box 31, and the upper half of the spring extends into a spring seat of the side beam 11 of the frame 1, a rubber pad is provided between the bottom of the spring 3 and the top of the rotating arm axle box 31 so as to absorb impact and high frequency vibration from the rail. The function of the primary vertical damper 32 is to reduce the vibration from the rail, which is a common design and will not be described herein. The present invention is characterized in that a two-stage suspension connection is provided between the vehicle body and the frame, that is, a third suspension that is arranged on the upper side of the bolster 2 and connected to the vehicle body, and a secondary suspension that is arranged between the lower portion of the bolster 2 and the transverse beam 12, to achieve functional separation. Specifically, the third suspension is only used to undertake a transverse displacement function, and the secondary suspension is only used to undertake a rotation function, thereby increasing an allowable transverse displacement and relative rotation angle between the vehicle body and the bogie when the vehicle passes through a curve, and thus improving curve passing capability of the vehicle. Wherein the secondary suspension is fixedly provided on the lower surface of the bolster 2, and correspondingly, the upper surface of the transverse beam 12 of the frame 1 is provided with a plurality of mounting seats 122 for mounting the secondary suspension.

For the bolster shown in FIGS. 1-5 and the bogie shown in FIGS. 6-9, the third suspension adopts a first air spring 21 as a supporting member, the first air spring ensures that the height of the vehicle remains unchanged, and a height adjusting valve 261 is arranged beside the first air spring 21. The vehicle body is supported by four air springs on a front bogie and a rear bogie. In addition to support the load of the vehicle body, these air springs are mainly used to isolate vibration the frame of the bogie, and achieve transverse displacement between the vehicle body and the bogie by deformation in the process of passing a curve. The first air spring 21 is a conventional technical means in the art and is not described in detail herein. However, the supporting member of the third suspension is not limited to be first air spring 21, and the first air spring 21 can be replaced by a laminated rubber pile, a spiral steel spring or any combination thereof. A person skilled in the art can also use any one of the air spring, laminated rubber pile and spiral steel spring or any combination thereof, as the supporting member of the third suspension, see the embodiments below.

Similarly, in the present embodiment, the secondary suspension includes a plurality of first laminated rubber piles 22, wherein the first laminated rubber piles 22 can be replaced with the air spring, the laminated rubber pile or the spiral steel spring, or any combination of the laminated rubber pile, the air spring and the spiral steel spring, see the embodiments below.

In this embodiment, the secondary suspension adopts the laminated rubber piles to bear forces in all directions and then attenuates part of the vibration by damping characteristic of the rubber, thereby playing a role of suspension. The main function of the secondary suspension is to undertake rotation function of the vehicle body and the bogie when the vehicle passes through a curve. Due to an alternate arrangement of the metal plate and the rubber in the laminated rubber piles, the laminated rubber piles can provide great vertical stiffness and minimal horizontal stiffness; and reduce rotation stiffness between the frame 1 and the bolster 2 and thus facilitates the bogie to pass through a curve. Meanwhile the great vertical stiffness will provide sufficient lateral roll stiffness for the bogie, so that flexibility coefficient of the bogie meets the overall requirement of the bogie. In order to avoid instability after excessive horizontal displacement of the laminated rubber piles, transverse spans of the laminated rubber piles should be reduced as much as possible on the premise of satisfying rolling performance of the vehicle. When the vehicle passes through a curve, due to large radial deformations of the laminated rubber piles, the bolster 2 (and the vehicle body connected with the bolster) has relatively large rotational movement relative to the frame 1, improving the curve passing capability of the vehicle.

In order to transfer the longitudinal load between the vehicle body and the bogie, in this embodiment, a Z-shaped traction rod 27 is arranged between the vehicle body and the bolster, as shown in FIG. 1, and a traction pin 23 is arranged between the bolster 2 and the frame 1. As shown in FIGS. 10-12, a traction pin hole 120 is formed in the middle of the transverse beam 12 of the frame 1, and correspondingly, as shown in FIGS. 1-9, the traction pin 23 is arranged in the middle of the lower side of the bolster 2, the bolster 2 is connected with the transverse beam 12 through the traction pin 23, and the traction pin 23 is sleeved with an elastic pin sleeve 231. The elastic pin sleeve 231 is in a laminated metal-rubber structure. As a preferred embodiment, an elastic pin hole sleeve 121 is arranged on the traction pin hole 120, and the pin hole sleeve 121 can also be a laminated metal-rubber structure. In this way, a pin connection is formed between the traction pin 23 and the traction pin hole 120, and the design goal of bogie having no lubrication point is achieved, which can meet the requirements of small rotation stiffness, small vertical stiffness (axial stiffness), and great longitudinal and transverse stiffness (radial stiffness), reduce the effect on rotation between the frame 1 and the bolster 2 of the bogie, and provide the transmission of longitudinal and transverse loads. The Z-shaped traction rod, forming a Z-shape when seeing from a top view, comprises two traction rods 27, which are located at two ends of the bolster 2 respectively. In order to install the traction rods 27, as shown in FIGS. 1 and 5, the two ends of the bolster 2 are respectively provided with a first mounting seat 271, two ends of each traction rod 27 are provided with a rubber node, one end of each traction rod 27 is arranged on a corresponding first mounting seat 271, the other end is connected with the vehicle body (not shown) by the rubber node. Thus, a transmission sequence of a longitudinal force (traction force or braking force) is as follows: (wheel-rail adhesion) wheel→axle→rotating arm axle box→rotating arm positioning seat→frame→traction pin (third suspension)→bolster→traction rod→traction rod seat→vehicle body→coupler.

As shown in FIGS. 1 and 4, a transverse buffer 24 is arranged in the middle of one side of the bolster 2, the transverse buffer 24 is in an open shape, and two opposite stop side surfaces thereof are respectively provided with a buffer rubber 241. A stop (not shown) connected with the vehicle body is located inside the transverse buffer 24, and keep a set distance with the two stop side surfaces. The function of the transverse buffer 24 is to limit an excessive transverse displacement between the vehicle body and the bogie, and when the transverse displacement between the vehicle body and the bogie exceeds the set distance, the stop connected with the vehicle body is in contact with the buffer rubber 241 on one of the stop side surfaces of the transverse buffer 24, and then a reverse compression force is generated, which can limit the transverse displacement of the vehicle. The buffer rubber has a non-liner performance, and its stiffness is gradually increasing with the increase of deflection. The buffer rubber 241 of the transverse buffer 24 can provide limiting and buffering when the vehicle body is subjected to a small transverse force.

In addition, referring to FIG. 1, a central pin hole 29 is formed in the middle of the upper side of the bolster 2, and is used for accommodating a rigid stop pin (not shown) arranged in the center of a bolster of the vehicle body. The rigid stop pin arranged in the center of the bolster of the vehicle body is welded on the bolster of the vehicle body and can be inserted into the central pin hole 29 in the center of the bolster 2 of the bogie, and there is always a certain gap kept between the rigid stop pin and the central pin hole in longitudinal direction and vertical direction during normal operation of the vehicle, and no contact occurs. When the vehicle is subjected to a large longitudinal force (for example, when two vehicles collide), the rigid stop pin of the bolster of the vehicle body is in contact with the central pin hole 29 on the bolster 2 so as to limit the separation of the vehicle from the bogie. When the vehicle is subjected to a large transverse force, the transverse buffer 24 is elastically compressed, and then the rigid stop pin will be in contact with the central pin hole 29 so as to limit an overlarge transverse displacement of the vehicle. In accordance with relevant laws and regulations, strength of the structure of the stop pin should be such that the structure does not break when the vehicle is subjected to an impact force of 250,000 pounds (113397.5 kg) in the event of collision, derailment and the like.

In order to achieve the purpose of vibration reduction, dampers are generally arranged in multiple directions in a suspension system. For example, as shown in FIGS. 1 to 5, two transverse dampers 25 are oppositely arranged on one side of the bolster 2, one end of each transverse damper 25 is connected with the bolster 2, and the other end of each transverse damper 25 is connected with the bottom (not shown) of the vehicle body, and the function of the transverse dampers is to attenuate transverse vibration between the vehicle body and the bogie. The transverse dampers 25 and the transverse buffer 24 are located on opposite two sides of the bolster 2 respectively.

Meanwhile, in order to further reduce vibration in vertical direction, two ends of the bolster 2 are respectively provided with a secondary vertical damper 26, the secondary vertical damper 26 is arranged beside corresponding first air spring 21. Two secondary vertical dampers are opposite to each other and diagonally symmetrically arranged at the two ends of the bolster 2 and are arranged in vertical direction, with the function of attenuating vertical vibration between the vehicle body and the bogie. In addition, an orifice is formed between an airbag chamber and an additional air chamber, inside the first air spring 21, and the flow of air through the orifice between the two chambers can also be used for attenuating the vertical vibration between the vehicle body and the bogie.

As shown in FIG. 1 and FIG. 5, the bogie of embodiment I further comprises an anti-yaw damper 28, one end of the anti-yaw damper 28 is arranged on the first mounting seat 271, and the other end is connected with the side beam 11 of the frame 1. The anti-yaw damper 28 that is arranged between the bolster 2 and the frame 1 can prevent yaw instability of a multiple-unit train during high-speed running. The anti-yaw damper 28 is a component frequently used in a high-speed multiple-unit train design, and its structure will not be described in detail herein.

The bogie of embodiment I further comprises a foundation brake device, and the foundation brake device comprises a tread brake unit and a disc brake unit. As shown in FIG. 10, two ends of each side beam 11 are respectively provided with a disc brake mounting seat 13 for mounting the disc brake unit, and an inner side of the concave portion of each side beam 11 is provided with two tread brake mounting seats 14 for mounting the tread brake unit. The tread brake unit and the disc brake unit are brake units commonly used in the field, and in the present embodiment, mounting positions of them are set according to the structure of the frame 1. Furthermore, the disc brake unit is used in combination with the tread brake unit, and the tread brake unit can improve adhesion between the wheel and the track and reducing running noise.

When the bogie is a power bogie, as shown in FIG. 10, motor hanging seats 18 and gearbox hanging seats 17 are arranged on the front side and the rear side of the transverse beam 12, both the motor hanging seats 18 and the gearbox hanging seats 17 are box-shaped welded structures, have the advantages of high strength and light weight. In order to reduce the weight, the motor hanging seats 18 and the gearbox hanging seats 17 of the present embodiment are welded structures. In fact, the motor hanging seats 18 and the gearbox hanging seats 17 can also be formed by forgings or castings.

Regarding the structure of the bolster 2, the bolster 2, as a load transfer member of the third suspension and the secondary suspension, integrates mounting interfaces of all components of the third suspension and the secondary suspension, and in the prior art, the bolster has three structural modes, steel plate welded structure, integral cast steel structure and integral cast aluminum structure respectively. In this embodiment, preferably, the bolster 2 adopts a box-shaped structure formed by welding a steel plate and internally provided with an internal rib plate. After completion of welding, the bolster 2 is integrally annealed and integrally machined to form a hollow box-shaped structure, as shown in FIG. 9.

Regarding the structure of the frame 1 as a basis for mounting other parts, as shown in FIG. 1, in order to correspond to the concave structure of the side beam, the front side and the rear side of the concave portion of each side beam 11 are provided with a rotating arm positioning seat 15 for mounting a rotating arm axle box. An outer side of each side beam 11 is provided with an anti-yaw damper mounting seat 16 for mounting the anti-yaw damper. Referring to FIG. 6, one end of the anti-yaw damper 28 is connected with the anti-yaw damper mounting seat 16 on the side beam 11, and the other end is connected with the first mounting seat 271 on the bolster 2.

For the sake of weight reduction, in this embodiment, the side beam 11 is a closed box body formed by welding steel plate, includes a lower cover plate and an upper cover plate that are formed by integral stamping of steel plate and is internally provided with a vertical plate, and two ends of each side beam 11 are welded with steel pipes and forged castings; the transverse beam 12 is also a box-shaped structure formed by welding a steel plate. In the cross-sectional view shown in FIG. 9, the side beams 11 and the transverse beam 12 are all hollow structures.

The primary suspension in embodiment I is additionally described below. As shown in FIG. 6, an axle box positioning device of the primary suspension adopts a mature rotating arm type elastic positioning mode, and one end of the rotating arm axle box 31 is connected with a bearing 33 of the wheelset, and the other end is connected with the rotating arm positioning seat 15 that is arranged on the front side or the rear side of the concave portion of each side beam 11, an elastic node of the rotating arm axle box 31 is a movable joint for connecting the wheelset and the frame, and in addition to transmitting force and vibration in all directions, the axle box must guarantee that the wheelset can adapt to the track condition to run up and down and transverse move left and right relative to the frame. The rotating arm axle box 31 is a mature technology for the primary suspension and is not further described in detail.

Embodiment II

Figure 14:
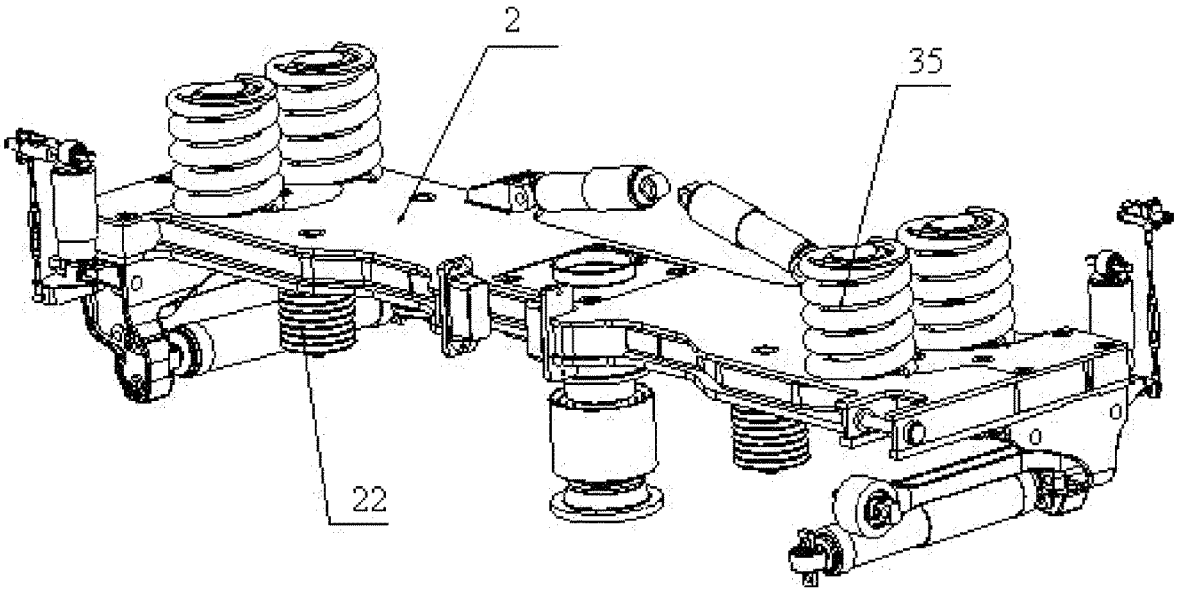
FIG. 14 is a schematic perspective view of a bolster of a bogie according to embodiment II of the present invention.
Figure 15:
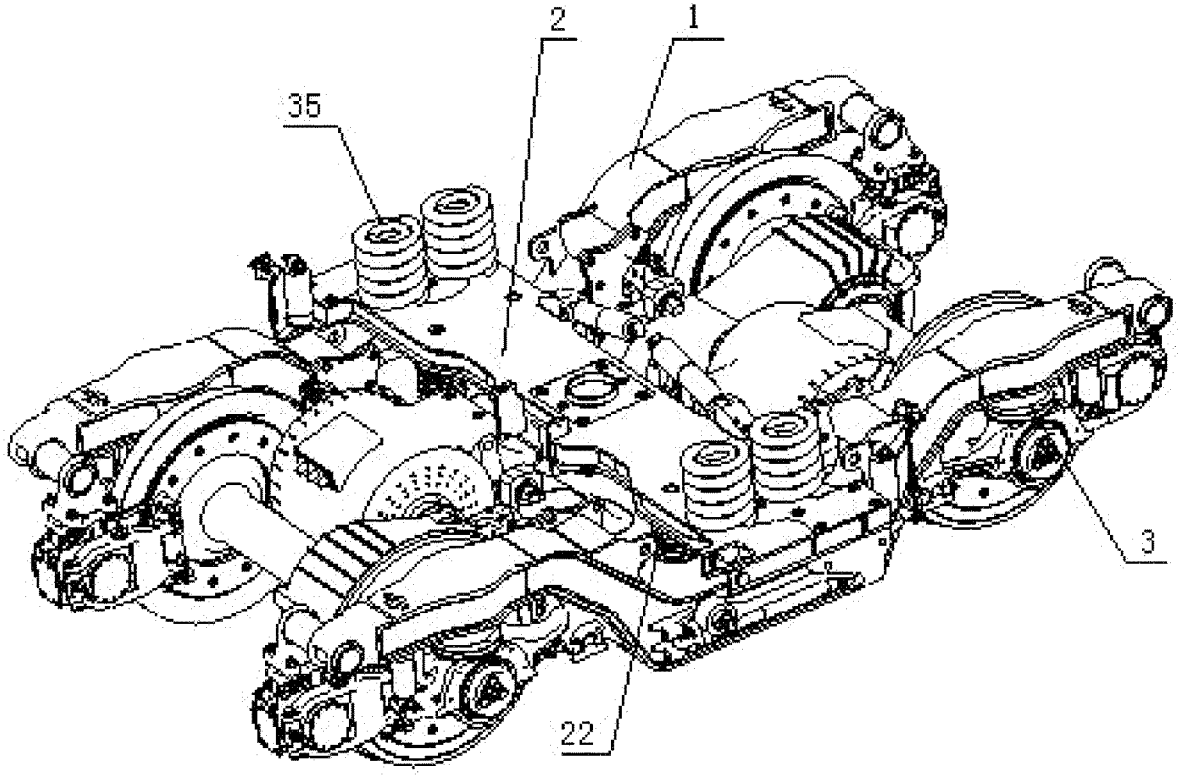
FIG. 15 is a schematic perspective view of a bogie using the bolster in embodiment II.

FIG. 14 is a schematic perspective view of a bolster of a bogie according to embodiment II of the present invention; FIG. 15 is a schematic perspective view of the bogie using the bolster of embodiment II. As shown in FIG. 14 and FIG. 15, the third suspension adopts a first spiral steel spring 35 to replace the first air spring 21 in embodiment I shown in FIG. 1. Obviously, there is a plurality of the first spiral steel spring 35, which are symmetrically distributed at two ends of the bolster 2. In the embodiment shown in FIG. 14, both the left end and the right end above the bolster 2 are provided with two first spiral steel springs 35 side by side.

Embodiment III

Figure 16:
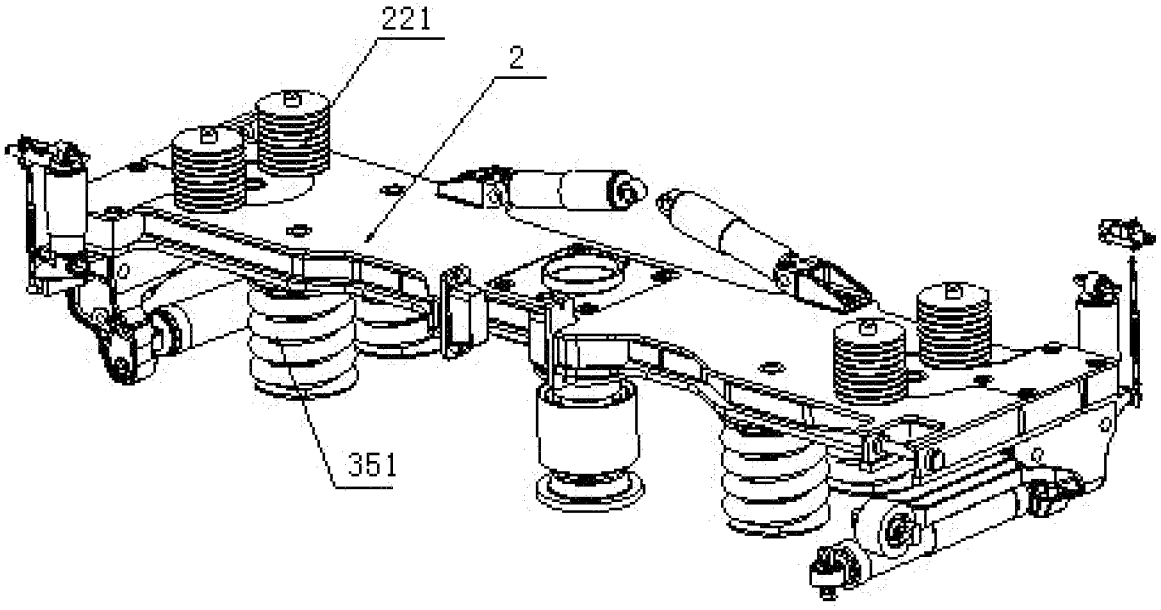
FIG. 16 is a schematic perspective view of a bolster of a bogie according to embodiment III of the present invention.
Figure 17:
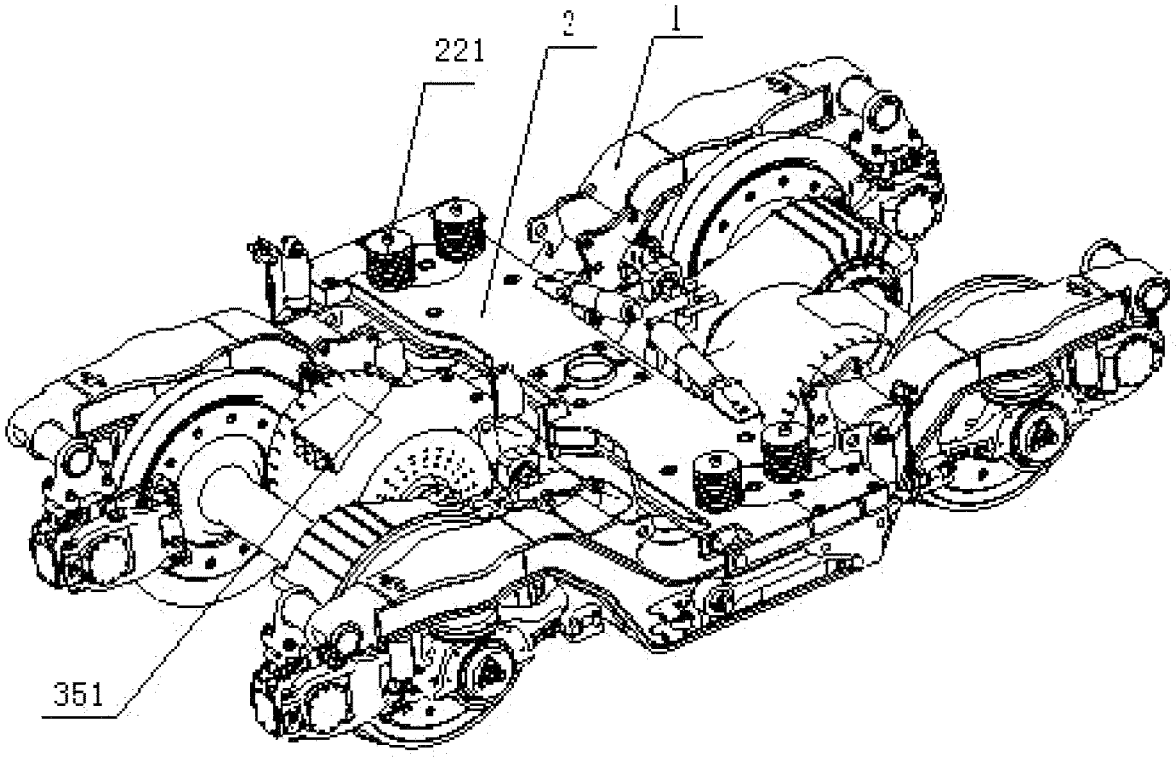
FIG. 17 is a schematic perspective view of a bogie using the bolster in embodiment III.
Figure 18:
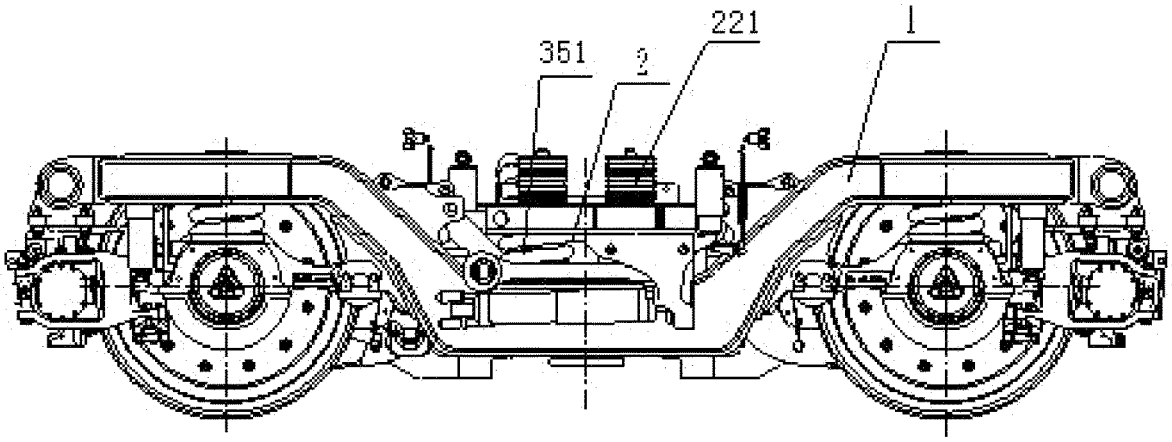
FIG. 18 is a front view of FIG. 17 (viewed from one side of a traveling direction)

FIG. 16 is a schematic perspective view of a bolster of a bogie according to embodiment III of the present invention; FIG. 17 is a schematic perspective view of a bogie using the bolster of embodiment III; FIG. 18 is a front view of FIG. 17 (viewed from one side of a traveling direction). The difference between embodiment III and embodiment I lies in the structures of the secondary suspension and the third suspension. As shown in FIGS. 16-18, in embodiment III, the third suspension adopts a plurality of second laminated rubber piles 221 as supporting members, and the secondary suspension adopts a plurality of second spiral steel springs 351 as supporting members, the plurality of second laminated rubber piles 221 and the plurality of second spiral steel springs 351 are symmetrically distributed at two ends of the bolster 2. In the embodiments shown in FIGS. 15 and 16, both the left end and the right end above the bolster 2 are provided with two second laminated rubber piles 221 side by side, and both the left end and the right end below the bolster 2 are provided with two second spiral steel springs 351 side by side.

Embodiment IV

Figure 19:
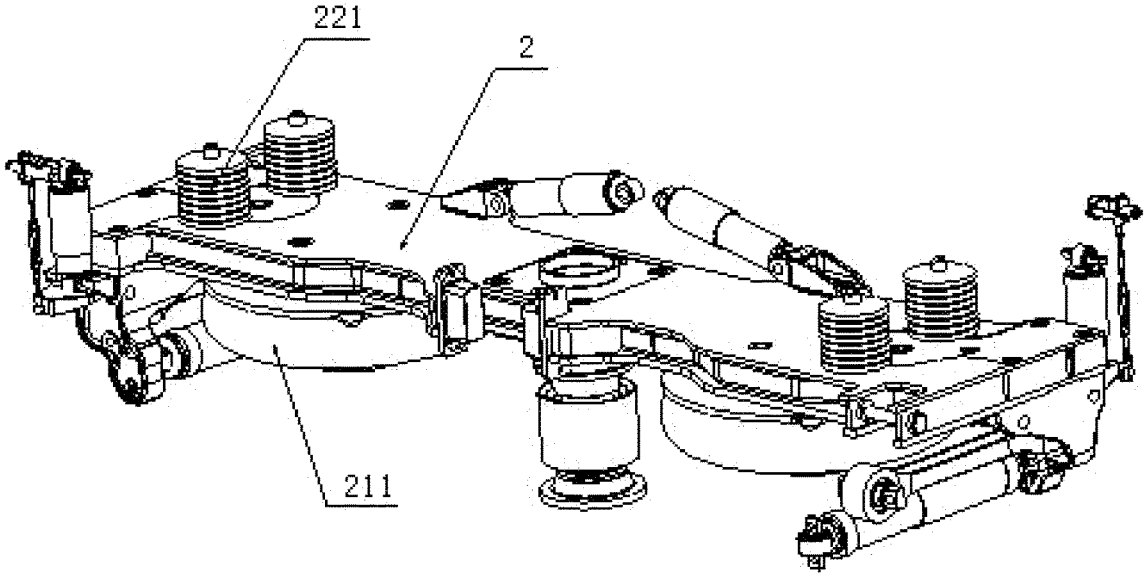
FIG. 19 is a schematic perspective view of a bolster of a bogie according to embodiment IV of the present invention.
Figure 20:
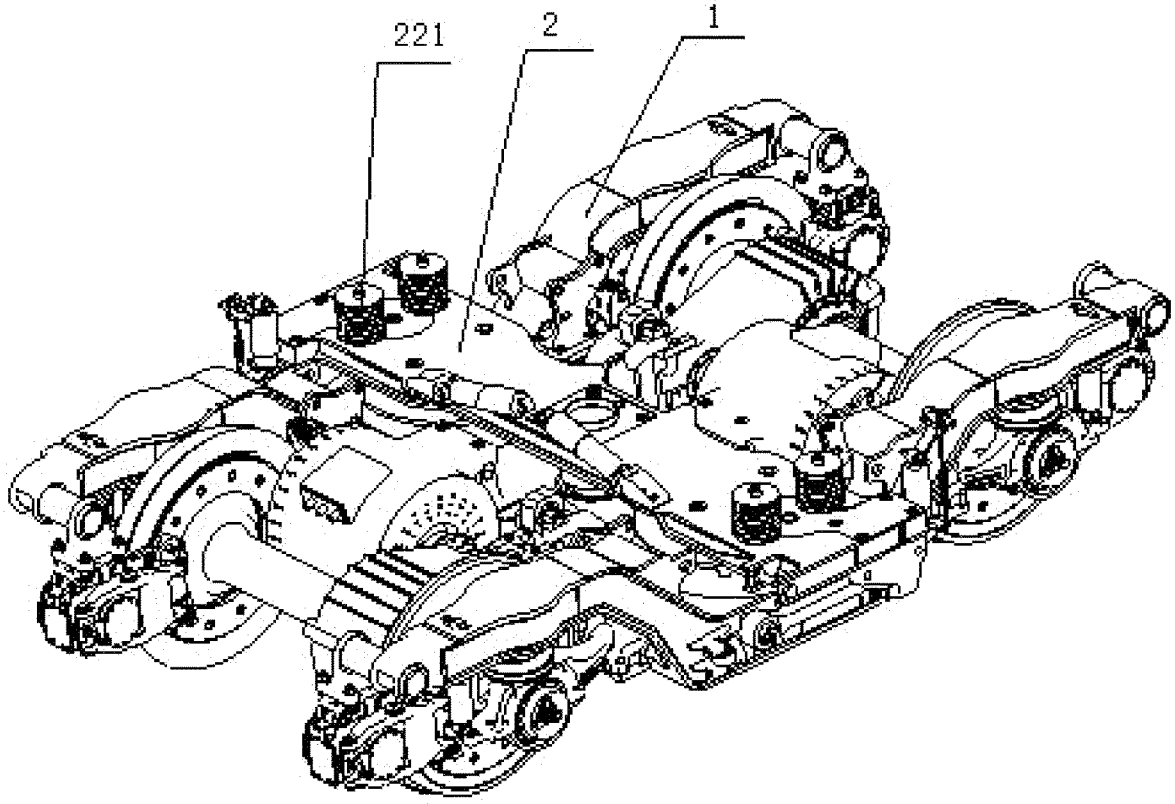
FIG. 20 is a schematic perspective view of a bogie using the bolster in embodiment IV.
Figure 21:
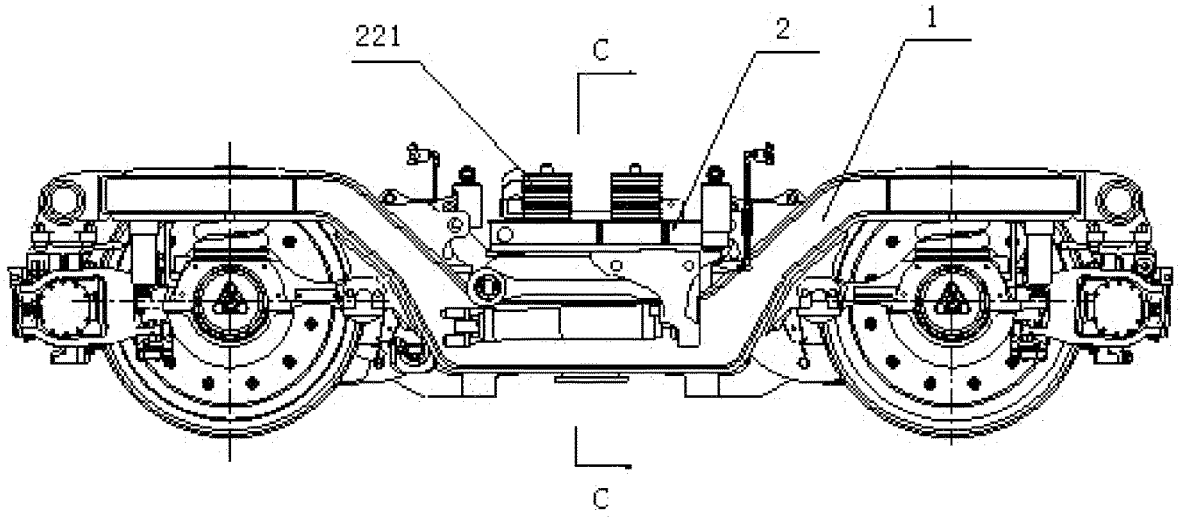
FIG. 21 is a front view of FIG. 20 (viewed from one side of a traveling direction)
Figure 22:
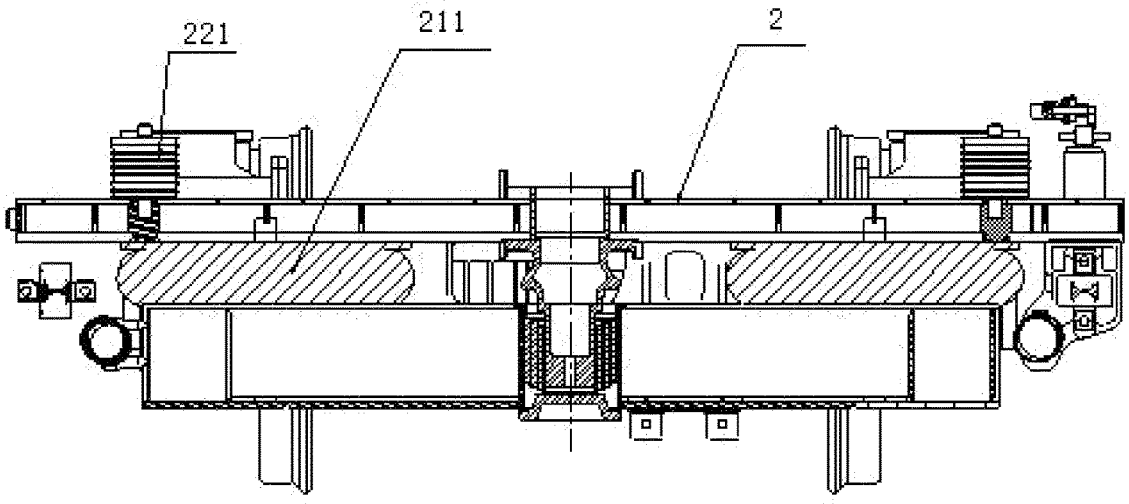
FIG. 22 is a cross-sectional view taken along line C-C of FIG. 21.

FIG. 19 is a schematic perspective view of a bolster of a bogie according to embodiment IV of the present invention, FIG. 20 is a schematic perspective view of a bogie using the bolster of embodiment IV, FIG. 21 is a front view of FIG. 20 (viewed from one side of a traveling direction), FIG. 22 is a cross-sectional view taken along line C-C of FIG. 21.

The difference between embodiment IV and embodiment III only lies in the structure of the secondary suspension. As shown in FIGS. 19-22, in embodiment IV, the secondary suspension uses one second air spring 211 to replace the two second spiral steel springs 351 arranged side by side in embodiment III. That is to say, in embodiment IV, both the left end and the right end above the bolster 2 are provided with two second laminated rubber piles 221 side by side, and both the left end and the right end below the bolster 2 are provided with one second air spring 211.

Embodiment V

Figure 23:
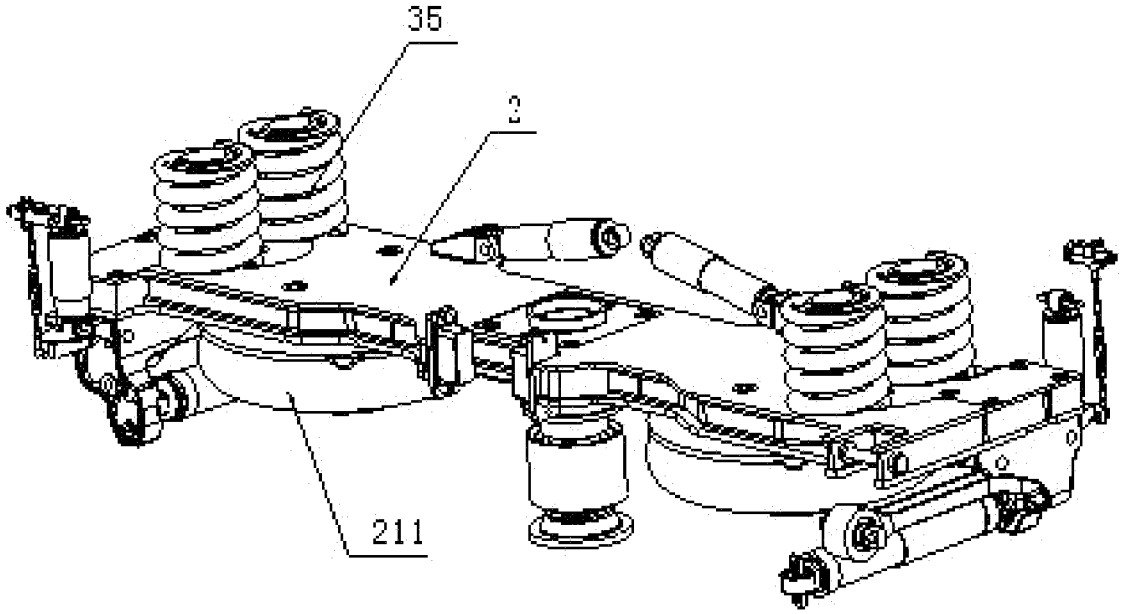
FIG. 23 is a schematic perspective view of a bolster of a bogie according to embodiment V of the present invention.
Figure 24:
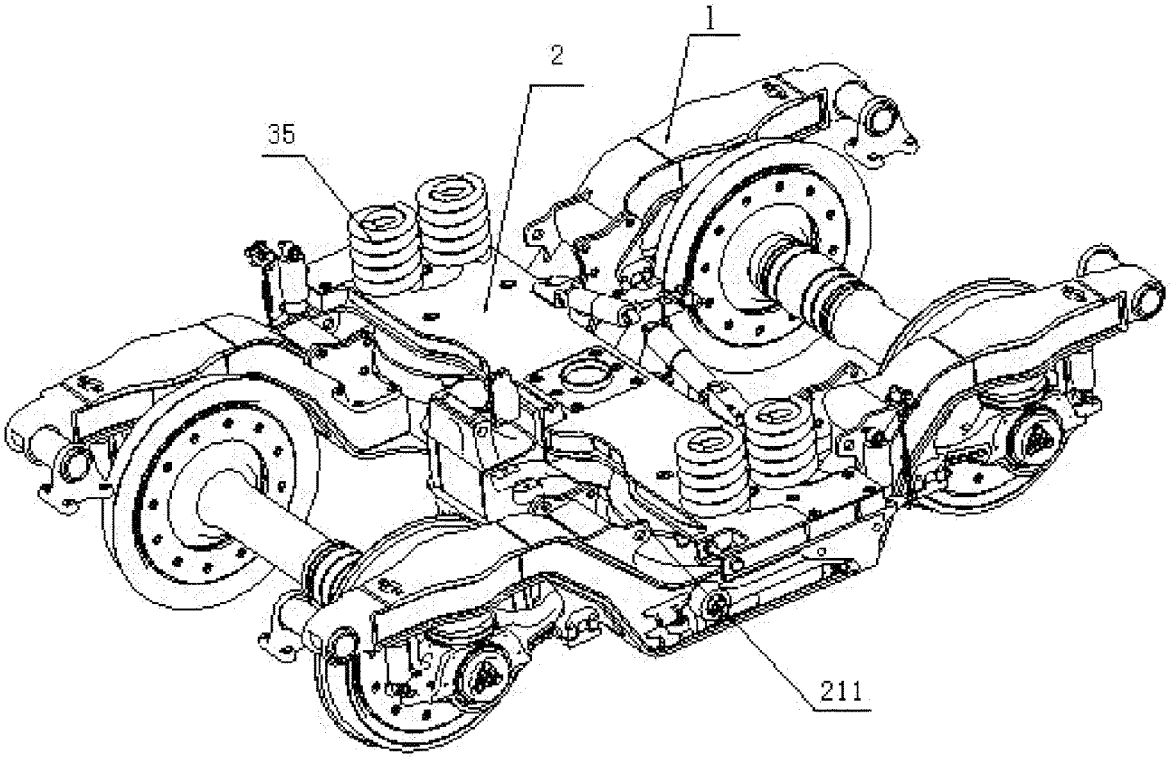
FIG. 24 is a schematic perspective view of a bogie using the bolster in embodiment V.
Figure 25:
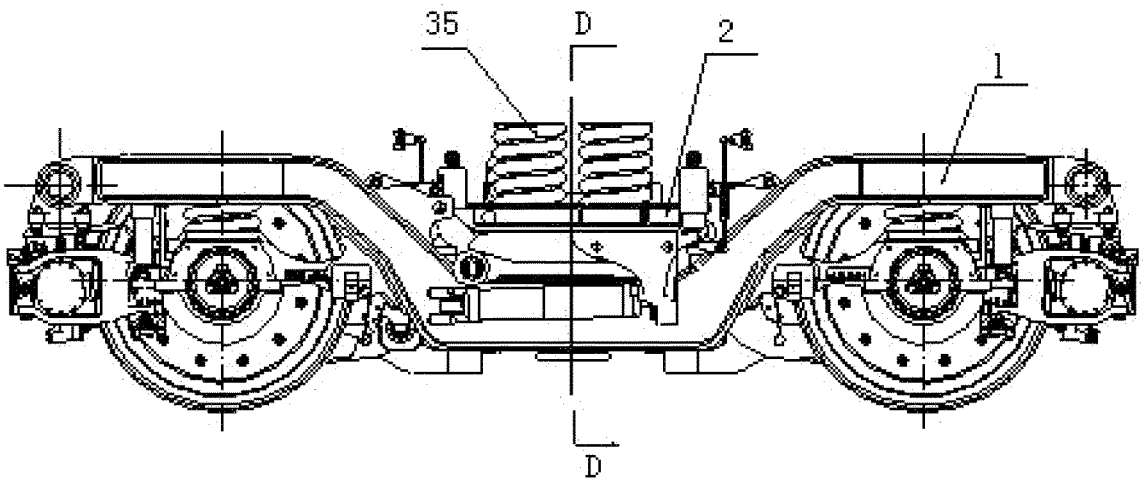
FIG. 25 is a front view of FIG. 24 (viewed from one side of a traveling direction)
Figure 26:
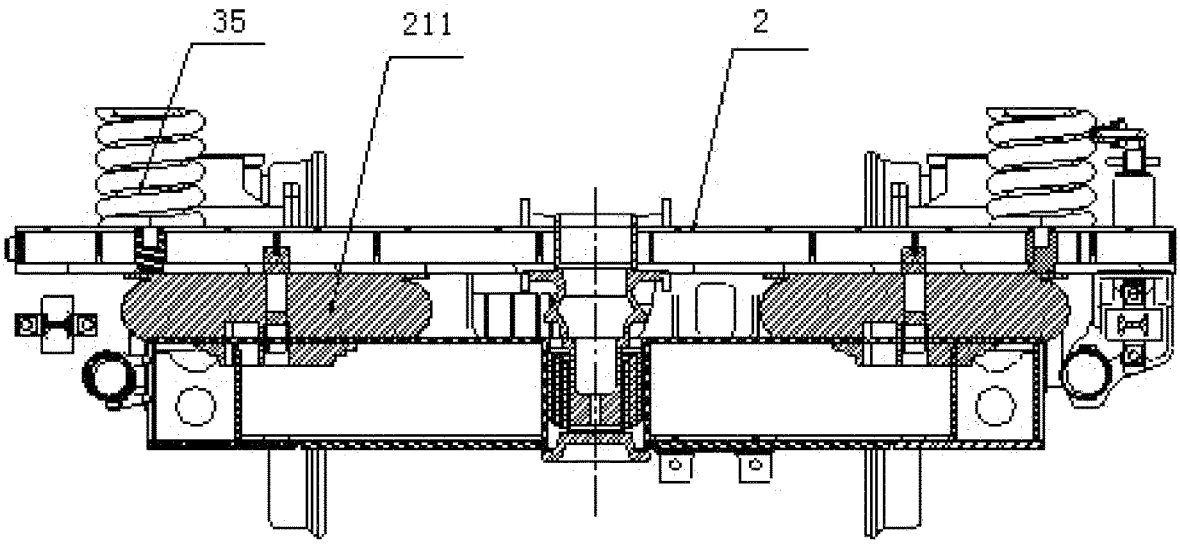
FIG. 26 is a cross-sectional view taken along line D-D of FIG. 25.
Figure 27:
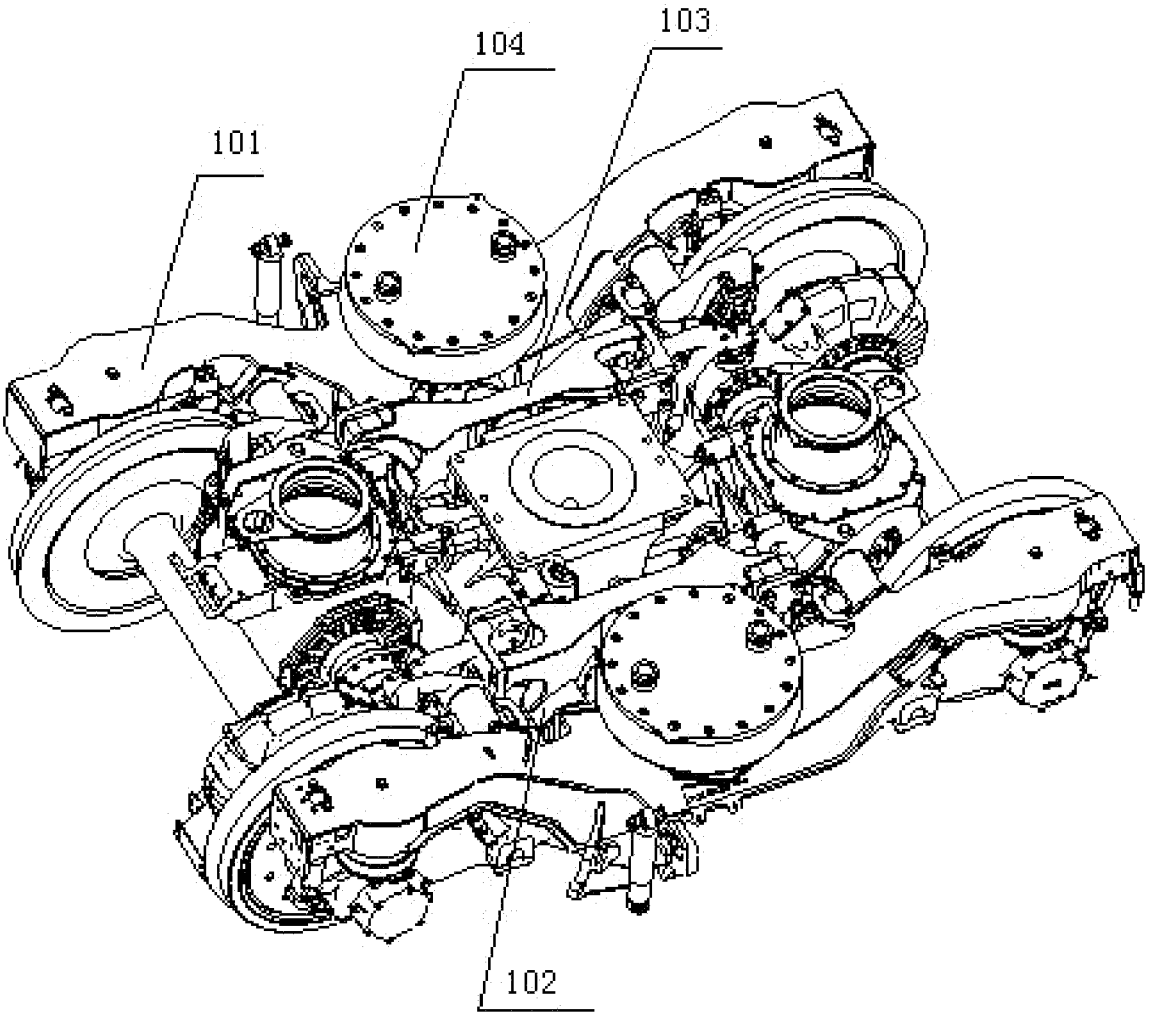
FIG. 27 is a schematic structural perspective view showing a bogie in the prior art.

FIG. 23 is a schematic perspective view of a bolster of a bogie according to embodiment V of the present invention; FIG. 24 is a schematic perspective view of a bogie using the bolster of embodiment V; FIG. 25 is a front view of FIG. 24 (viewed from one side of a traveling direction); FIG. 26 is a cross-sectional view taken along line D-D of FIG. 25.

The difference between embodiment V and embodiment II lies in the structure of the secondary suspension. As shown in FIGS. 20-21, the secondary suspension in embodiment V uses one second air spring 211 to replace the two first laminated rubber piles 22 arranged side by side in embodiment II. That is to say, in embodiment V, both the left end and the right end above the bolster 2 are provided with two first spiral steel springs 35 side by side, and both the left end and the right end below the bolster 2 are provided with one second air spring 211.

It should be noted that in the above embodiments I to V, the number, shape and size of the mounting seat 122 for mounting the secondary suspension, on the upper surface of the transverse beam 12 of the frame 1, are different due to difference in the structure of the supporting member of the secondary suspension, and should match with the structure of supporting member.

In summary, it can be seen from the description of the above-described embodiments I to V, by setting the bolster, the bogie of the present invention adds a suspension between the bottom of the bolster and the transverse beam on the basis of the original two-stage suspension, thereby achieving functional separation, so that the third suspension is only used to undertake a transverse displacement function, and the secondary suspension is only used to undertake a rotation function, thereby further increasing relative rotation angle between the vehicle body and the bogie when the vehicle passes through a curve, and improving curve passing capability of the vehicle. In addition, the combination of three suspensions can also achieve good vibration isolation and noise reduction, thereby effectively attenuating vibration generated by an interaction between the wheel and track, and improving comfort performance.

With regard to the terms, in the claims and embodiments of the present application, the suspension structures adopted in the bogie are called as primary suspension, secondary suspension and third suspension in the order from bottom to top. In addition, in "first laminated rubber pile", "first air spring", "first spiral steel spring", "second laminated rubber piles" and similar expressions, the "first" and "second" are only used for distinguishing different parts of the same kind.

Certainly, the descriptions above are only preferred embodiments of the invention, and it should be noted that a number of improvements and modifications can be made by those skilled in the art without departing from the principle of the invention, and these improvements and modifications are also within the scope of the invention.

What is claimed is:

1. A bolster of a bogie, wherein a traction pin is arranged in the middle of a lower side of the bolster, the bolster is connected with a transverse beam of the bogie through the traction pin, wherein the bolster further comprises a Z-shaped traction rod, two ends of the bolster are provided with a first mounting seat, two ends of the traction rod are provided with a rubber node, one end of the traction rod is arranged on the first mounting seat, and the other end of the traction rod is connected with a vehicle body.

2. The bolster of the bogie according to claim 1, wherein the traction pin is provided with an elastic pin sleeve.

3. The bolster of the bogie according to claim 2, wherein the elastic sleeve is a laminated metal-rubber structure.

4. The bolster of the bogie according to claim 1, wherein a secondary suspension connected with the transverse beam of the bogie is arranged below the bolster, and a third suspension connected with a vehicle body is arranged above the bolster.

5. The bolster of the bogie according to claim 4, wherein the third suspension comprises any one of a plurality of laminated rubber piles, air springs and spiral steel springs, or any combination thereof.

6. The bolster of the bogie according to claim 4, wherein the secondary suspension comprises any one of a plurality of laminated rubber piles, air springs and spiral steel springs, or any combination thereof.

7. The bolster of the bogie according to claim 1, wherein a transverse buffer is arranged in the middle of one side of the bolster.

8. The bolster of the bogie according to claim 7, wherein two transverse dampers are oppositely arranged on the other side of the bolster, one end of each transverse damper is connected with the bolster, and the other end of each transverse damper is connected with the bottom of a vehicle body.

9. The bolster of the bogie according to claim 1, wherein two ends of the bolster are provided with a secondary vertical damper.

10. The bolster of the bogie according to claim 1, further comprising an anti-yaw damper, with one end of the anti-yaw damper being arranged on a first mounting seat at two ends of the bolster, and the other end being connected with a side beam of a frame of the bogie.

11. The bolster of the bogie according to claim 1, wherein a central pin hole is formed in the middle of an upper side of the bolster, and is used for accommodating a rigid stop pin arranged in the center of a bolster of a vehicle body.

* * * * *